US011168458B2

(12) United States Patent
Shimizu et al.

(10) Patent No.: US 11,168,458 B2
(45) Date of Patent: Nov. 9, 2021

(54) WORK VEHICLE AND METHOD OF CONTROLLING WORK VEHICLE

(71) Applicant: KOMATSU LTD., Tokyo (JP)

(72) Inventors: Minoru Shimizu, Tokyo (JP); Nobuyoshi Yamanaka, Tokyo (JP); Toshiaki Kumagai, Tokyo (JP)

(73) Assignee: KOMATSU LTD., Tokyo (JP)

( * ) Notice: Subject to any disclaimer, the term of this patent is extended or adjusted under 35 U.S.C. 154(b) by 192 days.

(21) Appl. No.: 16/476,333

(22) PCT Filed: Feb. 20, 2018

(86) PCT No.: PCT/JP2018/005890
§ 371 (c)(1),
(2) Date: Jul. 8, 2019

(87) PCT Pub. No.: WO2018/151310
PCT Pub. Date: Aug. 23, 2018

(65) Prior Publication Data

US 2020/0040548 A1 Feb. 6, 2020

(30) Foreign Application Priority Data

Feb. 20, 2017 (JP) ..... JP2017-029276

(51) Int. Cl.
*E02F 3/43* (2006.01)
*E02F 9/20* (2006.01)
*E02F 9/26* (2006.01)

(52) U.S. Cl.
CPC ..... *E02F 3/43* (2013.01); *E02F 9/20* (2013.01); *E02F 9/26* (2013.01)

(58) Field of Classification Search
CPC ... E02F 3/283; E02F 3/43; E02F 3/431; E02F 9/20; E02F 9/2012; E02F 9/2029; E02F 9/26; E02F 9/265
See application file for complete search history.

(56) References Cited

U.S. PATENT DOCUMENTS 4,633,383 A * 12/1986 Omachi ..... E02F 9/26 37/348
4,889,466 A * 12/1989 Jindai ..... E02F 3/301 414/694

(Continued)

FOREIGN PATENT DOCUMENTS

JP S60-10024 A 1/1985
JP S60-112936 A 6/1985

(Continued)

*Primary Examiner* — Tyler J Lee
(74) *Attorney, Agent, or Firm* — Faegre Drinker Biddle & Reath LLP

(57) ABSTRACT

A work vehicle includes a work implement and a controller. The work implement includes a vehicular body that travels in excavation, a boom pivotable with respect to the vehicular body, and a bucket pivotable with respect to the boom. The controller calculates a direction of a cutting edge of the bucket, determines a direction of movement of the cutting edge by an excavation operation such that an excavation angle between the calculated direction of the cutting edge of the bucket and the direction of movement of the cutting edge by the excavation operation keeps a predetermined angle, and causes the work vehicle to perform the excavation operation in the direction of movement.

6 Claims, 9 Drawing Sheets

(56) References Cited

U.S. PATENT DOCUMENTS 4,945,221 A * 7/1990 Nielsen ..... E02F 3/435 250/203.1
5,178,510 A * 1/1993 Hanamoto ..... E02F 3/437 37/348
5,308,219 A * 5/1994 Lee ..... E02F 3/435 414/695.5
5,356,259 A * 10/1994 Hanamoto ..... E02F 3/437 37/348
5,446,981 A * 9/1995 Kamada ..... E02F 3/437 172/2
5,701,691 A * 12/1997 Watanabe ..... E02F 3/435 172/4
5,713,144 A * 2/1998 Haraoka ..... E02F 9/26 37/348
5,735,065 A * 4/1998 Yamagata ..... E02F 9/2033 37/348
5,752,333 A * 5/1998 Nakagawa ..... E02F 3/437 37/348
5,887,365 A * 3/1999 Fujishima ..... E02F 3/437 37/348
5,968,104 A * 10/1999 Egawa ..... E02F 3/437 701/50
6,076,029 A * 6/2000 Watanabe ..... E02F 3/437 701/50
6,098,322 A * 8/2000 Tozawa ..... E02F 3/437 37/414
6,108,948 A * 8/2000 Tozawa ..... E02F 3/435 37/348
6,778,097 B1 * 8/2004 Kajita ..... E02F 3/437 340/12.5
8,065,060 B2 * 11/2011 Danko ..... B25J 9/1628 701/50
9,650,755 B2 * 5/2017 Nomura ..... E02F 9/264
2007/0168100 A1 * 7/2007 Danko ..... E02F 9/2004 701/50
2017/0107688 A1 4/2017 Fujii et al.
2017/0218595 A1 * 8/2017 Padilla ..... E02F 9/264
2018/0030693 A1 * 2/2018 Padilla ..... E02F 9/265

FOREIGN PATENT DOCUMENTS

JP H03-8929 A 1/1991
JP H09-053259 A 2/1997
JP 2001-98585 A 4/2001
JP 2007-224511 A 9/2007
WO WO 93/09300 A1 5/1993
WO WO 2016/052762 A1 4/2016

* cited by examiner

WORK VEHICLE AND METHOD OF CONTROLLING WORK VEHICLE

TECHNICAL FIELD

The present disclosure relates to a work vehicle.

BACKGROUND ART

A work vehicle such as a wheel loader includes a bucket pivotable in a dump direction at the tip of a boom pivotable in the up-down direction. An operator operates an operation apparatus to cause the bucket to pivot in the dump direction and accordingly be located substantially horizontally, and then, performs excavation work of running the work vehicle to penetrate the bucket into the mountain of soil. Through this excavation work, a load is loaded into the bucket. The operator causes the boom or the body to revolve to cause the work vehicle to face a transportation machine such as a dump track, thereby lifting the boom above a box. When the operator causes the bucket to pivot in the dump direction, the load in the bucket falls onto the box, so that the load is transferred to the transportation machine. Loading work is performed by repeating such a cycle multiple times.

In one conventional technique, the operation of a work implement is controlled automatically for an efficient excavation operation.

For example, Japanese Patent Laying-Open No. 2007-224511 (PTL 1) discloses a way of controlling the orientation of a bucket to prevent a spill of the load in the bucket.

CITATION LIST

Patent Literature

PTL 1: Japanese Patent Laying-Open No. 2007-224511

SUMMARY OF INVENTION

Technical Problem

The excavation operation of a work vehicle such as a wheel loader needs to operate an accelerator for running the work vehicle, and simultaneously, operate the movement of the bucket by individually moving the operation levers of the boom and the bucket. It is thus not easy to perform an efficient excavation operation, which requires some skill.

The present disclosure has been made to solve the above problem, and has an object to provide a work vehicle capable of performing an efficient excavation operation in a simple way and a method of controlling a work vehicle.

Solution to Problem

A work vehicle of the present disclosure includes a work implement and a controller. The work implement includes a vehicular body that travels in excavation, a boom pivotable with respect to the vehicular body, and a bucket pivotable with respect to the boom. The controller is configured to calculate a direction of a cutting edge of the bucket, determine a direction of movement of the cutting edge by an excavation operation such that an excavation angle between the calculated direction of the cutting edge of the bucket and the direction of movement of the cutting edge by the excavation operation keeps a predetermined angle, and cause the work vehicle to perform an excavation operation in the direction of movement.

A method of controlling a work vehicle of the present disclosure is a method of controlling a work vehicle including a work implement including a boom pivotable with respect to a vehicular body that travels in excavation and a bucket pivotable with respect to the boom. The method includes calculating a direction of a cutting edge of the bucket, determining a direction of movement of the cutting edge by an excavation operation such that an excavation angle between the calculated direction of the cutting edge of the bucket and the direction of movement of the cutting edge by the excavation operation keeps a predetermined angle, and causing the work vehicle to perform the excavation operation in the direction of movement.

Another work vehicle of the present disclosure includes a work implement and a display controller. The work implement includes a vehicular body that travels in excavation, a boom pivotable with respect to the vehicular body, and a bucket pivotable with respect to the boom. The display controller is configured to calculate a direction of a cutting edge of the bucket, determine a direction of movement of the cutting edge by an excavation operation such that an excavation angle between the calculated direction of the cutting edge of the bucket and the direction of movement of the cutting edge by the excavation operation keeps a predetermined angle, and show guidance in accordance with the determined direction of movement on a display.

Another method of controlling a work vehicle of the present disclosure is a method of controlling a work vehicle including a work implement including a boom pivotable with respect to a vehicular body that travels in excavation and a bucket pivotable with respect to the boom. The other method includes calculating a direction of a cutting edge of the bucket, determining a direction of movement of the cutting edge by an excavation operation such that an excavation angle between the calculated direction of the cutting edge of the bucket and the direction of movement of the cutting edge by the excavation operation keeps a predetermined angle, and showing guidance in accordance with the determined direction of movement on the display.

Advantageous Effects of Invention

The work vehicle of the present disclosure and the method of controlling the same can perform an efficient excavation operation in a simple way.

DESCRIPTION OF EMBODIMENTS

Hereinafter, embodiments of the present disclosure will be described with reference to the drawings, although the present disclosure is not limited thereto. Any constituent element of each embodiment described below can be combined as appropriate. Some constituent element may not be used.

Hereinbelow, a wheel loader will be described with reference to the drawings as an example work vehicle. In the description below "up (upward)", "down (downward)", "front", "rear", "left", and "right" are terms with an operator seated at an operator's seat being defined as the reference.

<General Configuration>

Figure 1:
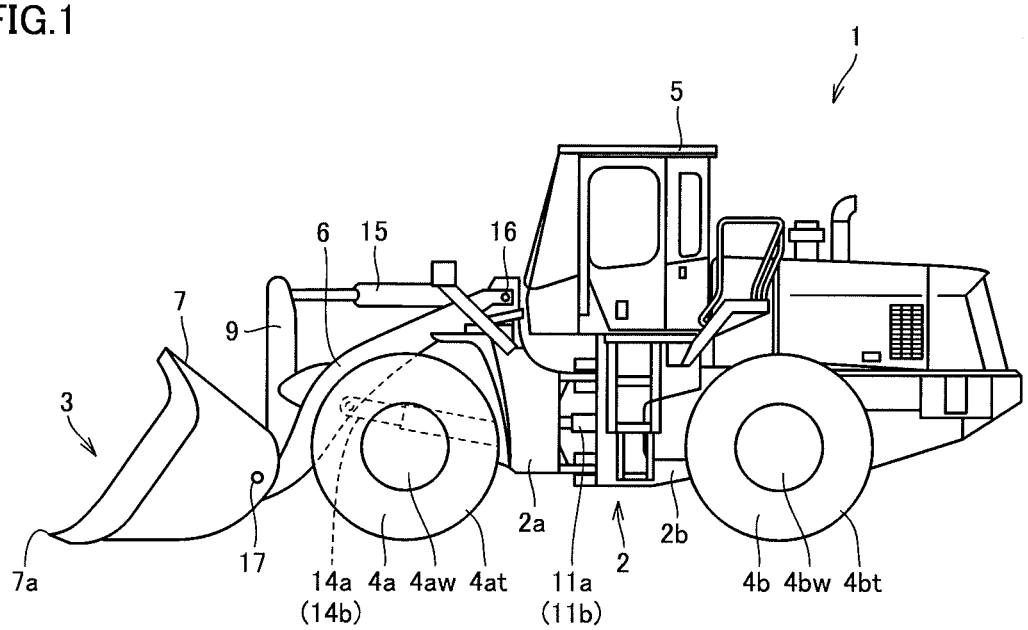
FIG. 1 shows appearance of a wheel loader 1 according to an embodiment.

FIG. 1 shows appearance of a wheel loader 1 according to an embodiment.

As shown in FIG. 1, wheel loader 1 includes a body 2, a work implement 3, wheels 4*a* and 4*b*, and an operator's cab 5. Wheel loader 1 is mobile as wheels 4*a* and 4*b* are rotationally driven and can perform desired work with work implement 3.

Body 2 includes a front vehicular body portion 2*a* and a rear vehicular body portion 2*b*. Front vehicular body portion 2*a* and rear vehicular body portion 2*b* are coupled to each other in a manner swingable in the let-right direction.

A pair of steering cylinders 11*a* and 11*b* are provided across front vehicular body portion 2*a* and rear vehicular body portion 2*b*. Steering cylinders 11*a* and 11*b* are hydraulic cylinders driven by the hydraulic oil from a steering pump 12 (see FIG. 2). As steering cylinders 11*a* and 11*b* extend and contract, front vehicular body portion 2*a* swings with respect to rear vehicular body portion 2*b*. This changes the direction of travel of wheel loader 1.

Figure 2:
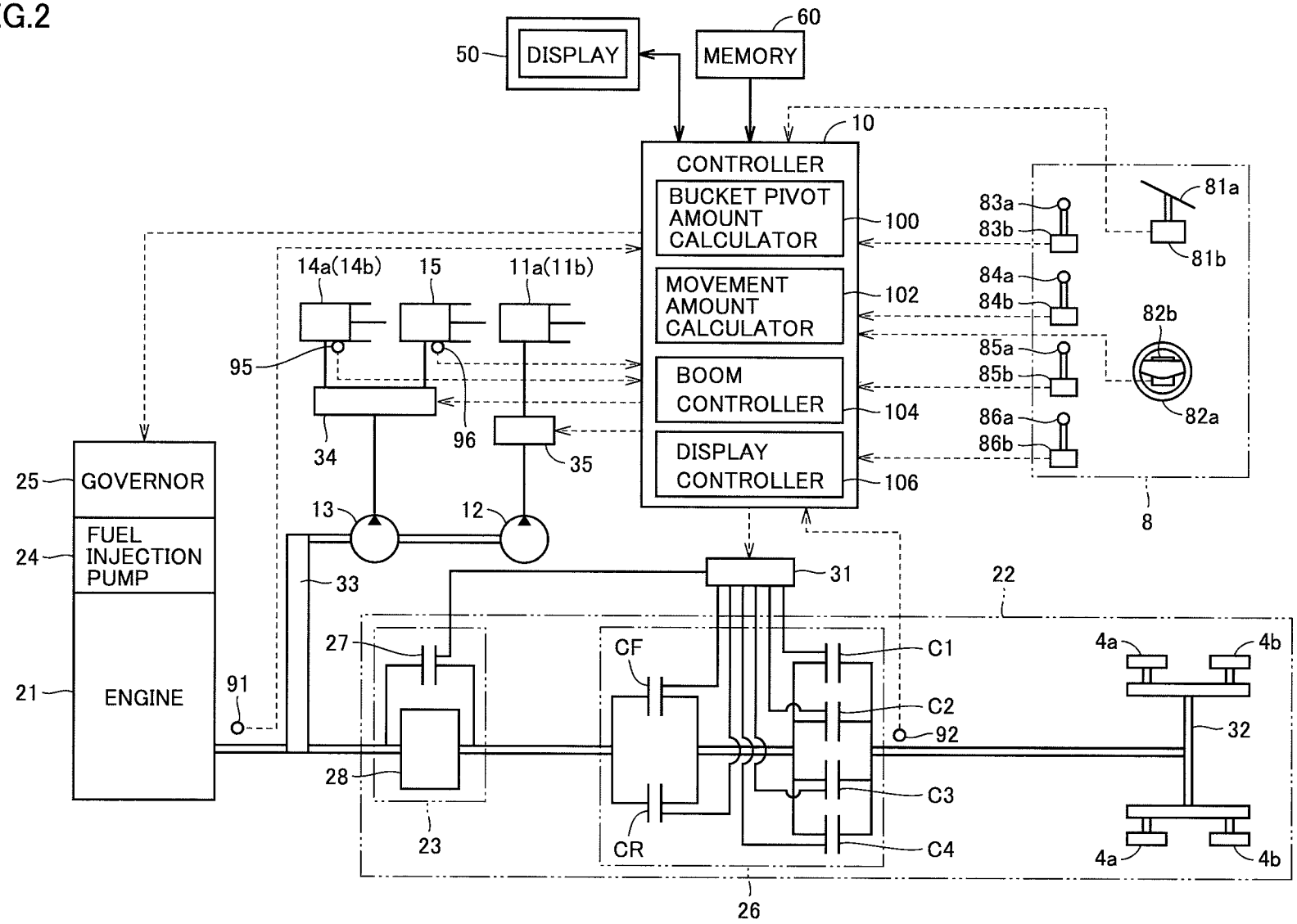
FIG. 2 is a schematic diagram showing a configuration of wheel loader 1 according to the embodiment.

FIGS. 1 and 2, which will be described below, show only one of steering cylinders 11*a* and 11*b* and do not show the other.

Work implement 3 and a pair of front wheels 4*a* are attached to front vehicular body portion 2*a*. Work implement 3 is disposed in front of body 2. Work implement 3 is driven by the hydraulic oil from a work implement pump 13 (see FIG. 2). Work implement 3 includes a boom 6, a pair of boom cylinders 14*a* and 14*b*, a bucket 7, a bell crank 9, and a bucket cylinder 15.

Boom 6 is rotatably supported by front vehicular body portion 2*a*. The base end of boom 6 is pivotably attached to front vehicular body portion 2*a* by a boom pin 16. Boom cylinders 14*a* and 14*b* have first ends attached to front vehicular body portion 2*a*. Boom cylinders 14*a* and 14*b* have second ends attached to boom 6. Front vehicular body portion 2*a* and boom 6 are coupled to each other by boom cylinders 14*a* and 14*b*. As boom cylinders 14*a* and 14*b* extend and contract by the hydraulic oil from work implement pump 13, boom 6 pivots upward and downward with boom pin 16 at its center.

FIGS. 1 and 2 show only one of boom cylinders 14*a* and 14*b* and do not show the other.

Bucket 7 is pivotably supported at the tip end of boom 6. Bucket 7 is pivotably supported at the tip end of boom 6 by a bucket pin 17.

Bucket cylinder 15 has a first end attached to front vehicular body portion 2*a*. Bucket cylinder 15 has a second end attached to bell crank 9. Bell crank 9 and bucket 7 are coupled to each other by a link apparatus (not shown). Front vehicular body portion 2*a* and bucket 7 are coupled to each other by bucket cylinder 15, bell crank 9, and the link apparatus. As bucket cylinder 15 extends and contracts by the hydraulic oil from work implement pump 13, bucket 7 pivots upward and downward with bucket pin 17 as its center.

Operator's cab 5 and a pair of rear wheels 4*b* are attached to rear vehicular body portion 2*b*. Operator's cab 5 is placed in body 2. A seat on which the operator is seated, operation unit 8 which will be described below, and the like are provided in operator's cab 5.

Front wheel 4*a* includes a wheel portion 4*aw* and a tire 4*at*. Tire 4*at* is attached to the outer circumference of wheel portion 4*aw*. Rear wheel 4*b* includes a wheel portion 4*bw* and a tire 4*bt*. Tire 4*bt* is attached to the outer circumference of wheel portion 4*bw*. Tires 4*at* and 4*bt* are made of elastic material. Tires 4*at* and 4*bt* are made of, for example, rubber.

FIG. 2 is a schematic diagram showing a configuration of wheel loader 1 according to the embodiment.

As shown in FIG. 2, wheel loader 1 includes an engine 21 serving as a drive source, a traveling apparatus 22, work implement pump 13, a steering pump 12, an operation unit 8, a controller 10, and a display 50.

Engine 21 is a diesel engine. Engine 21 includes a fuel injection pump 24. Fuel injection pump 24 is provided with an electronic governor 25. Power of engine 21 is controlled by regulating an amount of fuel injected into a cylinder. Such regulation is achieved by electronic governor 25 being controlled by controller 10.

Commonly used as governor 25 is an all speed control type governor. Governor 25 regulates the engine speed and the amount of fuel injection in accordance with a load such that the engine speed attains to a target speed in accordance with an amount of accelerator operation which will be described below. Governor 25 increases or decreases the amount of fuel injection such that there is no difference between a target speed and an actual engine speed.

The engine speed is detected by an engine speed sensor 91. A detection signal from engine speed sensor 91 is input to controller 10.

Traveling apparatus 22 is an apparatus for running wheel loader 1 by the drive force from engine 21. Traveling apparatus 22 includes a torque converter device 23, a transmission 26, and front wheels 4*a* and rear wheels 4*b* described above.

Torque converter device 23 includes a lock-up clutch 27 and a torque converter 28. Lock-up clutch 27 is a hydraulic-actuated clutch. Supply of the hydraulic oil to lock-up clutch 27 is controlled by controller 10 through clutch control valve 31, so that lock-up clutch 27 is switchable between a coupled state and a decoupled state. When lock-up clutch 27 is in the decoupled state, torque converter 28 transmits the drive force from engine 21 with the oil serving as a medium. When lock-up clutch 27 is in the coupled state, the input side and the output side of torque converter 28 are directly coupled to each other.

Transmission 26 includes a forward clutch CF corresponding to a forward drive gear and a rearward clutch CR corresponding to a reverse drive gear. With switching between the coupled state and the decoupled state of clutches CF and CR, the vehicle is switched between forward drive and reverse drive. When both of clutches CF and CR are in the decoupled state, the vehicle is in a neutral state.

Transmission 26 includes a plurality of velocity stage clutches C1 to C4 corresponding to a plurality of velocity stages and can switch a reduction gear ratio in a plurality of stages. Each of velocity stage clutches C1 to C4 is a hydraulic-actuated hydraulic clutch. Hydraulic oil is supplied from a hydraulic pump (not shown) through clutch control valve 31 to clutches C1 to C4. Clutch control valve 31 is controlled by controller 10 to control supply of the hydraulic oil to clutches C1 to C4, so that clutches C1 to C4 are switched between the coupled state and the decoupled state.

An output shaft of transmission 26 is provided with a T/M output speed sensor 92. T/M output speed sensor 92 detects the speed of the output shaft of transmission 26. A detection signal from T/M output speed sensor 92 is input to controller 10. Controller 10 calculates a vehicle speed based on the detection signal from T/M output speed sensor 92.

The drive force output from transmission 26 is transmitted to wheels 4*a* and 4*b* through shaft 32 or the like. This causes wheel loader 1 to travel. Part of the drive force from engine 21 is transmitted to traveling apparatus 22, thus causing wheel loader 1 to travel.

Part of the drive force of engine 21 is transmitted to work implement pump 13 and steering pump 12 through a power take off (PTO) shaft 33. Work implement pump 13 and steering pump 12 are hydraulic pumps driven by the drive force from engine 21. The hydraulic oil discharged from work implement pump 13 is supplied to boom cylinders 14*a* and 14*b* and bucket cylinder 15 through work implement control valve 34. The hydraulic oil discharged from steering pump 12 is supplied to steering cylinders 11*a* and 11*b* through steering control valve 35. Work implement 3 is driven by part of the drive force from engine 21.

A boom cylinder stroke sensor 95 is disposed in boom cylinder 14*a* (14*b*) and detects a stroke length (boom cylinder length) of boom cylinder 14*a* (14*b*).

A bucket cylinder stroke sensor 96 is disposed in bucket cylinder 15 and detects a stroke length (bucker cylinder length) of bucket cylinder 15. The stroke length of boom cylinder 14*a* (14*b*) is also referred to as a boom cylinder length or a lift stroke. The stroke length of bucket cylinder 15 is also referred to as a bucket cylinder length or a tilt stroke. Also, the boom cylinder length and the bucket cylinder length are collectively referred to as cylinder length data.

Operation unit 8 is operated by an operator. Operation unit 8 includes an accelerator operation member 81*a*, an accelerator operation detector 81*b*, a steering operation member 82*a*, a steering operation detector 82*b*, a boom operation member 83*a*, a boom operation detector 83*b*, a bucket operation member 84*a*, a bucket operation detector 84*b*, a transmission operation member 85*a*, a transmission operation detector 85*b*, an FR operation member 86*a*, and an FR operation detector 86*b*.

Accelerator operation member 81*a* is operated to set a target speed of engine 21. Accelerator operation member 81*a* is, for example, an accelerator pedal. Increasing an amount of operation (for an accelerator pedal, an amount of depression) of accelerator operation member 81*a* accelerates the body. Reducing an amount of operation of accelerator operation member 81*a* decelerates the body. Accelerator operation detector 81*b* detects an amount of operation of accelerator operation member 81*a*. The amount of operation of accelerator operation member 81*a* is referred to as an accelerator operation amount. Accelerator operation detector 81*b* detects an accelerator operation amount. Accelerator operation detector 81*b* outputs a detection signal to controller 10.

Steering operation member 82*a* is operated to operate the direction of travel of a vehicle. Steering operation member 82*a* is, for example, a steering handle. Steering operation detector 82*b* detects the position of steering operation member 82*a* and outputs a detection signal to controller 10. Controller 10 controls steering control valve 35 based on the detection signal from steering operation detector 82*b*. Steering cylinders 11*a* and 11*b* extend and contract, thereby changing the direction of travel of the vehicle.

Boom operation member 83*a* is operated to operate boom 6. Bucket operation member 84*a* is operated to operate bucket 7. Boom operation member 83*a* and bucket operation member 84*a* are, for example, operation levers. Boom operation detector 83*b* detects a position of boom operation member 83*a*. Bucket operation detector 84*b* detects a position of bucket operation member 84*a*. Boom operation detector 83*b* and bucket operation detector 84*b* output detection signals to controller 10. Controller 10 controls work implement control valve 34 based on the detection signals from boom operation detector 83*b* and bucket operation detector 84*b*. As boom cylinders 14*a* and 14*b* and bucket cylinder 15 extend and contract, boom 6 and bucket 7 operate.

Transmission operation member 85*a* is operated to set a velocity stage of transmission 26. Transmission operation member 85*a* is, for example, a shift lever. Transmission operation detector 85*b* detects a position of transmission operation member 85*a*. Transmission operation detector 85*b* outputs a detection signal to controller 10. Controller 10 controls the transmission of transmission 26 based on the detection signal from transmission operation detector 85*b*.

FR operation member 86*a* is operated to switch the vehicle between forward drive and reverse drive. FR operation member 86*a* is switched among a forward drive position, a neutral position, and a reverse drive position. FR operation detector 86*b* detects a position of FR operation member 86*a*. FR operation detector 86*b* outputs a detection signal to controller 10. Controller 10 controls clutch control valve 31 based on the detection signal from FR operation detector 86*b*. Forward clutch CF and rearward clutch CR are controlled, so that the vehicle is switched among forward drive, reverse drive, and the neutral state.

Display 50 can show various types of information in excavation work. Controller 10 is commonly implemented as a central processing unit (CPU) reads various programs.

Controller 10 is connected with memory 60. Memory 60 functions as a work memory and stores various programs for implementing the function of the wheel loader.

Controller 10 sends an engine command signal to governor 25 so as to obtain a target speed in accordance with the amount of operation of accelerator operation member 81*a*.

Controller 10 includes a bucket pivot amount calculator 100, a movement amount calculator 102, a boom controller 104, and a display controller 106 as a functional block.

Bucket pivot amount calculator 100 calculates an amount of pivot of bucket 7 in accordance with the detection result of bucket operation detector 84*b* of bucket operation member 84*a*.

Movement amount calculator 102 calculates an amount of movement of body 2 per command period T. The amount of movement is calculated based on a vehicle speed in accordance with the detection result of accelerator operation detector 81*b* of accelerator operation member 81*a*. The vehicle speed can be calculated based on the detection signal of T/M output speed sensor 92.

Boom controller 104 calculates an amount of lift by which boom 6 is automatically lifted, and automatically controls boom 6 based on a calculation result. The way of this control will be described below.

Display controller 106 controls the contents of display on display 50.

Figure 3:
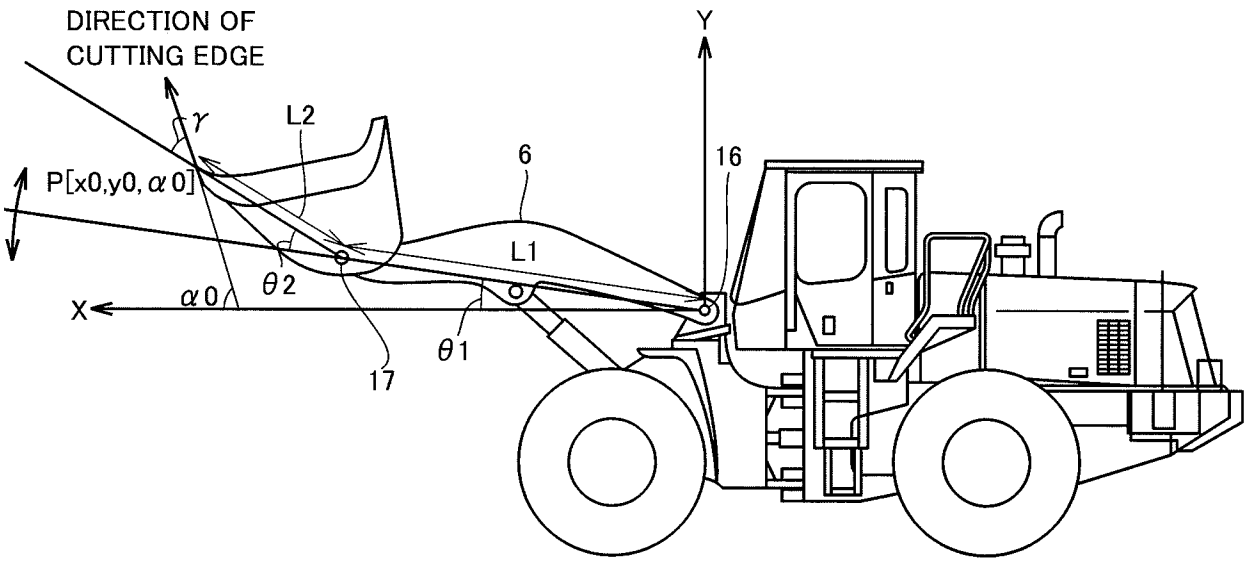
FIG. 3 schematically illustrates wheel loader 1 according to the embodiment.

FIG. 3 schematically illustrates wheel loader 1 according to the embodiment.

As shown in FIG. 3, a length L1 of boom 6 is a distance between boom pin 16 that is a rotation support center of boom 6 and bucket pin 17 that is a rotation support center of bucket 7 with respect to front vehicular body portion 2*a*. A length L2 of bucket 7 is a distance between bucket pin 17 and the tip end of the cutting edge of bucket 7.

FIG. 3 shows a coordinate system of X- and Y-axes with boom pin 16 serving as a reference point (reference position). The X-axis is a horizontal direction, and the Y-axis is a vertical direction perpendicular to the horizontal direction. Another coordinate system of X- and Y-axes with a fixed point serving as a reference point (reference position) may be used.

A tilt angle θ1 of boom 6 to the horizontal direction of the coordinate system is calculated from lift length data detected by boom cylinder stroke sensor 95.

A tilt angle θ2 of bucket 7 to boom 6 is calculated from tilt length data detected by bucket cylinder stroke sensor 96. Tilt angle θ2 is positive in a clockwise direction and is negative in a counterclockwise direction with respect to a line connecting boom pin 16 and bucket pin 17. Shown here is the case in which, for tilt angle θ2, bucket 7 pivots in the positive direction.

Although description will be given of a way of detecting a stroke length with a stroke sensor and calculating a tilt angle θ, a tilt angle may be calculated with an angle detector, for example, a rotary encoder.

The position of the cutting edge of bucket 7 in the coordinate system of X- and Y-axes and the angle of the cutting edge (a direction of the cutting edge) of bucket 7 can be calculated based on lengths L1 and L2 and tilt angles θ1 and θ2 of boom 6 and bucket 7.

FIG. 3 shows position coordinates [x0, y0] of cutting edge data P of the cutting edge of bucket 7, and an angle [α0] of the cutting edge to the horizontal direction of the cutting edge of bucket 7.

Angle α0 of the cutting edge (the direction of the cutting edge) of bucket 7 is represented by tilt angle θ1+tilt angle θ2+tilt angle γ. Tilt angle γ is a tilt angle in the direction of the cutting edge to a line connecting bucket pin 17 and the tip end of the cutting edge of bucket 7, which is a fixed angle preliminarily designed.

Figure 4:
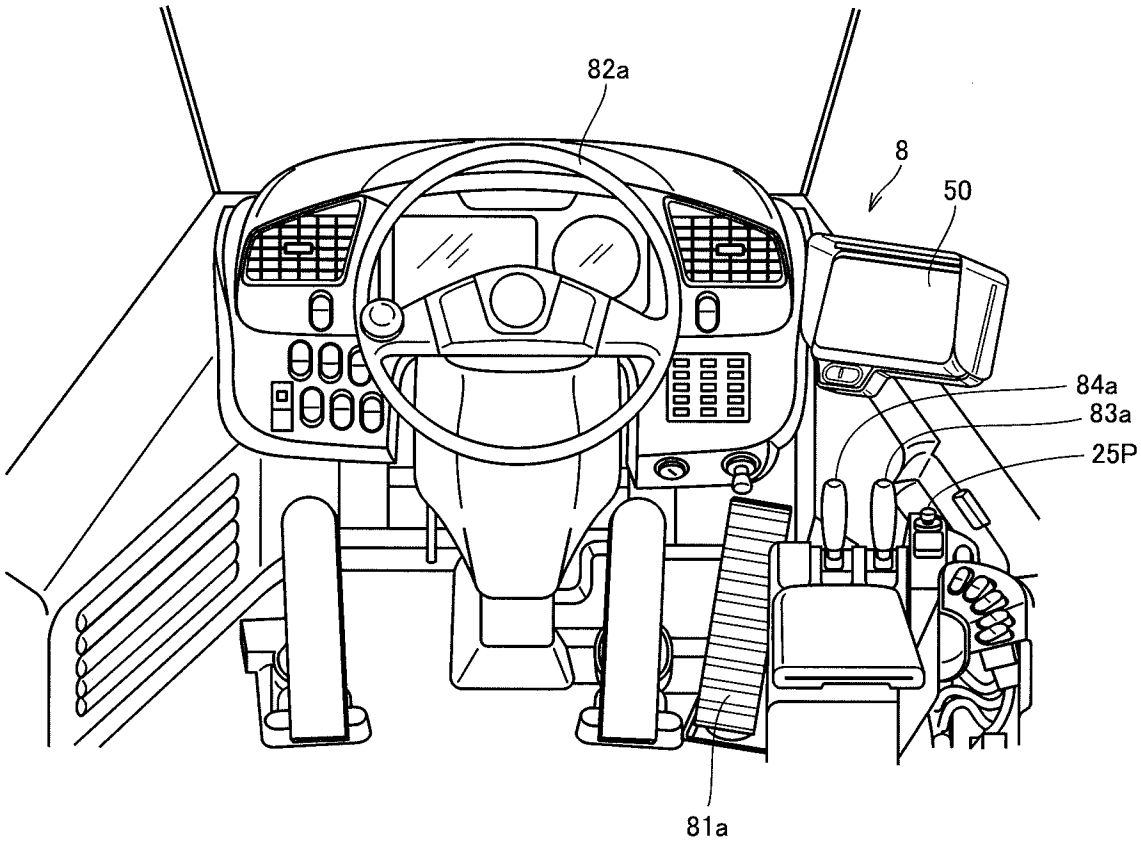
FIG. 4 illustrates an overview of an operator's cab 5 according to the embodiment.

FIG. 4 illustrates an outline of operator's cab 5 according to the embodiment.

As shown in FIG. 4, a seat on which the operator is seated is provided, and operation unit 8 and display 50 of various types are provided.

FIG. 4 shows the case in which accelerator operation member 81*a*, steering operation member 82*a*, boom operation member 83*a*, boom operation detector 83*b*, bucket operation member 84*a*, excavation mode setting button 25P, and the like are provided.

Excavation mode setting button 25P is a setting button for setting to an excavation mode. Controller 10 shifts from a normal mode to the excavation mode in accordance with an operator's instruction to depress excavation mode setting button 25P. Controller 10 shifts from the excavation mode to the normal mode in accordance with another operator's instruction to depress excavation mode setting button 25P.

Operation unit 8 can change a function corresponding to an operation between in the normal mode and in the excavation mode.

In the normal mode, boom 6 and bucket 7 are operated by boom operation member 83*a* and bucket operation member 84*a*.

The operation of boom operation member 83*a* in the front-back direction corresponds to the operation of boom 6, and an operation of lowering boom 6 and an operation of raising boom 6 are performed in accordance with the operation in the front-back direction. The lever is operated to operate boom 6.

Boom operation detector 83*b* detects an amount of operation in the forward and rearward direction of boom operation member 83*a* (boom operation amount). Boom operation detector 83*b* outputs a detection result to controller 10. Controller 10 drives work implement control valve 34 through which the hydraulic oil supplied to boom cylinders 14*a* and 14*b* for driving boom 6 flows, in accordance with the detection result of boom operation detector 83*b*.

The operation of bucket operation member 84*a* in the front-back direction corresponds to the operation of bucket 7, and the excavation operation and the releasing operation of bucket 7 are performed in accordance with the operation in the front-back direction. The lever is operated to operate bucket 7.

Bucket operation detector 84*b* detects an amount of operation in the forward and rearward direction of bucket operation member 84*a* (an amount of bucket operation). Bucket operation detector 84*b* outputs a detection result to controller 10. Controller 10 drives work implement control valve 34 through which the hydraulic oil supplied to bucket cylinder 15 for driving bucket 7 flows, in accordance with the detection result of bucket operation detector 84*b*.

The operation of depressing accelerator operation member 81*a* (accelerator pedal) corresponds to the setting of the target speed of engine 21, which controls the vehicle speed.

Accelerator operation detector 81*b* detects an amount of operation of accelerator operation member 81*a* (for an accelerator pedal, an amount of depression). Accelerator operation detector 81*b* outputs the detection result to controller 10. Controller 10 controls governor 25 that regulates the amount of injection of fuel injected to engine 21, in accordance with the detection result of accelerator operation detector 81*b*.

In the excavation mode, the operation of boom operation member 83*a* in the front-back direction is invalid. The lever operation for operating boom 6 is thus not accepted. Boom 6 is controlled automatically by boom controller 104. For bucket operation member 84*a* and accelerator operation member 81*a*, the operation is as in the normal mode.

[Resistance of Soil]

Figure 5:
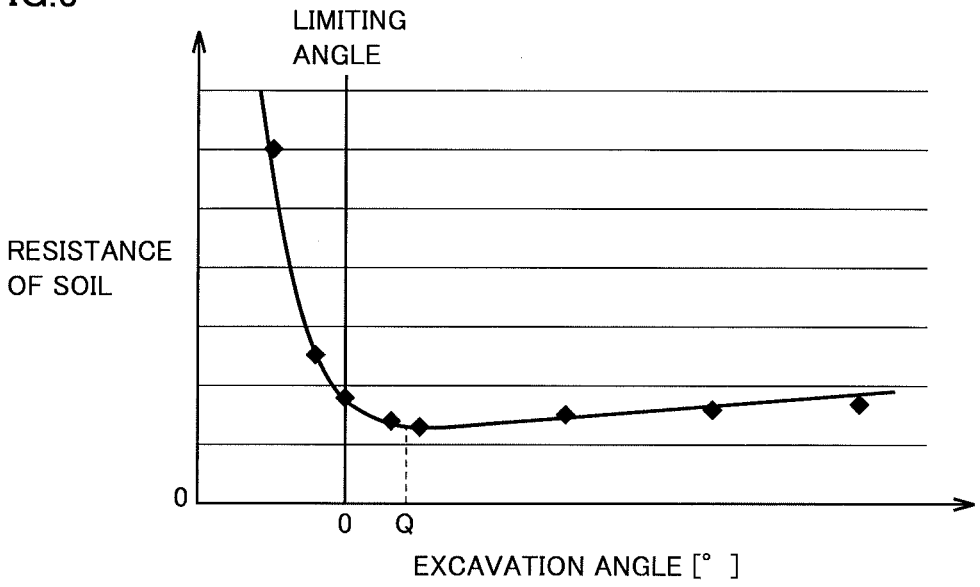
FIG. 5 shows a relationship between an excavation angle of a bucket 7 and a resistance of soil according to the embodiment.

FIG. 5 illustrates a relationship between an excavation angle of bucket 7 and a resistance of soil according to the embodiment.

The excavation angle refers to an angle between the direction of the cutting edge of bucket 7 and the direction of movement (direction of displacement) of the cutting edge by the excavation operation. The excavation angle has a positive value when the cutting edge of bucket 7 moves toward the opening surface side of bucket 7 and has a negative value when the cutting edge of bucket 7 moves in the opposite direction in movement of bucket 7 with reference to the direction of the cutting edge of bucket 7.

As shown in FIG. 5, the excavation angle of bucket 7 around 0° is represented as a limiting angle.

When the excavation angle of bucket 7 is smaller than the limiting angle, soil is pressed more against the exterior of bucket 7 or the back of bucket 7, so that the value of the resistance of soil applied to bucket 7 increases sharply.

It is shown that at the excavation angle of bucket 7 which is equal to a predetermined angle Q, the resistance of soil applied to bucket 7 has the smallest value.

The limiting angle and predetermined angle Q are merely examples and can be set to different values in accordance with the form of bucket 7.

Wheel loader 1 according to the embodiment performs the excavation process at an excavation angle with a resistance of soil having a small value, thus performing an efficient excavation operation in a simple way. Specifically, wheel loader 1 performs the excavation process while keeping the excavation angle at predetermined angle Q. Attaining to predetermined angle Q does not mean that an angle completely matches predetermined angle Q but includes any approximate value of predetermined angle Q.

[Operation Process]

Figure 6:
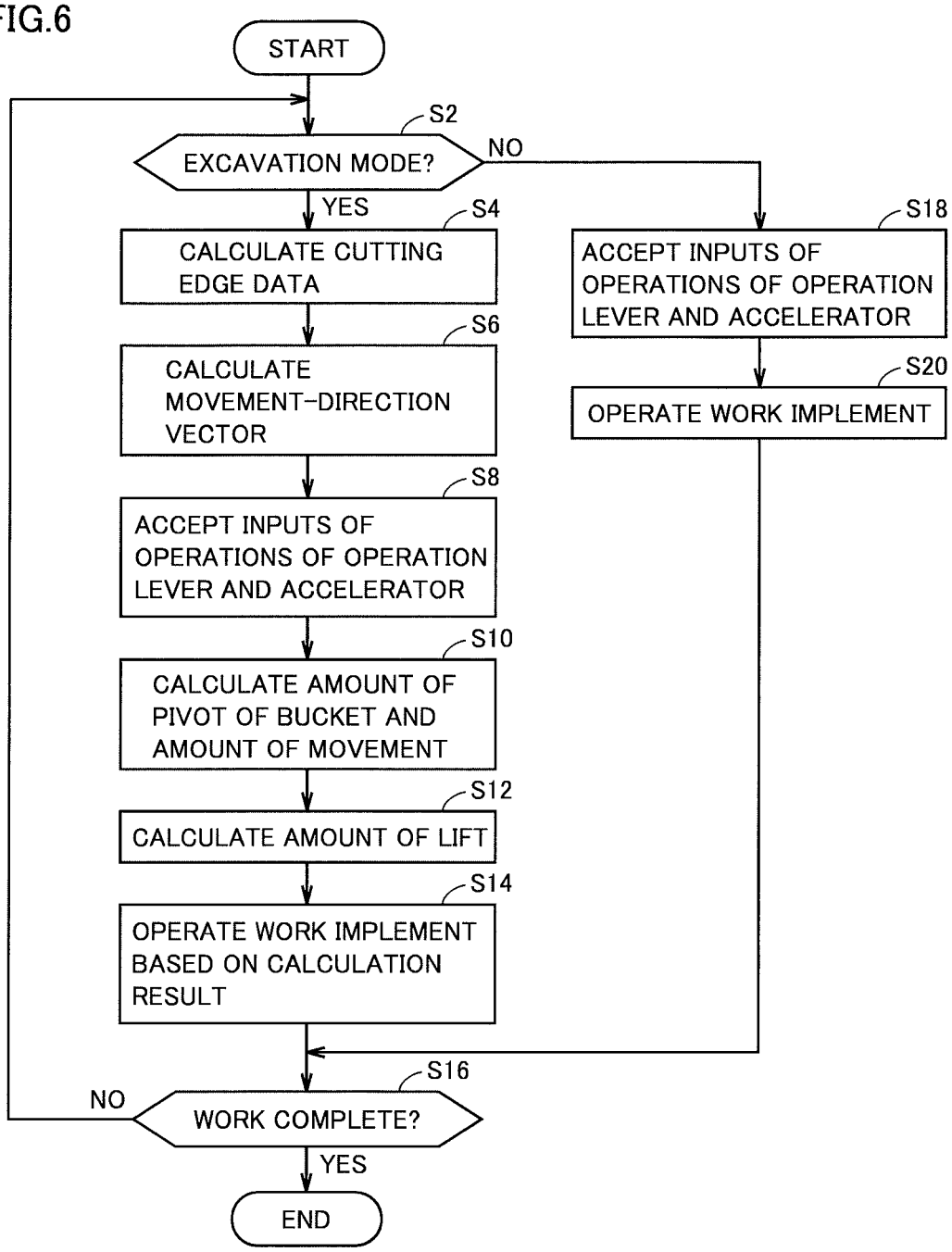
FIG. 6 illustrates an operation process of excavation work of wheel loader 1 according to the embodiment.

FIG. 6 illustrates the operation process of excavation work of wheel loader 1 according to the embodiment.

As shown in FIG. 6, controller 10 determines whether the mode is the excavation mode (step S2). Specifically, controller 10 determines whether it has accepted a setting instruction of the excavation mode setting button to set to the excavation mode in accordance with an operator's operation command.

If determining at step S2 that the mode is the excavation mode, controller 10 calculates cutting edge data (step S4).

Specifically, boom controller 104 calculates a boom cylinder length and a bucket cylinder length based on the detection results of boom cylinder stroke sensor 95 and bucket cylinder stroke sensor 96. Tilt angle θ1 of boom 6 to the horizontal direction is calculated from the boom cylinder length. Tilt angle θ2 of cutting edge of bucket 7 to boom 6 is calculated from the bucket cylinder length. Consequently, cutting edge data is calculated, which represents the position of the cutting edge of bucket 7 in the coordinate system of X- and Y-axes and the direction of the cutting edge (cutting edge direction) of bucket 7. The position coordinates of the cutting edge of bucket 7 are represented by P0 [x0, y0]. The angle of the cutting edge (cutting edge direction) of bucket 7 is represented by a cutting edge angle α0.

Cutting edge data P0 [x0, y0] is represented by the following expression.

$$P0[x0,y0]=[L1\cos\theta1+L2\cos(\theta1+\theta2),L1\sin\theta1+L2\sin(\theta1+\theta2)] \quad \text{[Math 1]}$$

Subsequently, controller 10 calculates a movement-direction vector V (step S6).

Specifically, boom controller 104 calculates movement-direction vector V such that the excavation angle formed between the direction of the cutting edge of bucket 7 and the direction of movement of the cutting edge of bucket 7 attains to predetermined angle Q. This determines the direction of movement of the cutting edge of bucket 7 by the excavation operation.

Unit vectors dx and dy in the X-axis direction and the Y-axis direction, which represent movement-direction vector V in the coordinate system of this example, are represented by the following expressions.

$$dx=\cos(\alpha0+Q)$$

$$dy=\sin(\alpha0+Q)$$

Subsequently, controller 10 accepts inputs of operations of the operation lever and the accelerator (step S8).

Controller 10 accepts the inputs of operations of bucket operation member 84*a* and accelerator operation member 81*a*.

In the excavation mode, bucket operation member 84*a* performs the operation of pivoting bucket 7. Traveling apparatus 22 performs the operation of moving body 2 by the amount of the accelerator operation of accelerator operation member 81*a*. In contrast, the input of boom operation member 83*a* is not accepted.

Subsequently, controller 10 calculates an amount of pivot of the bucket and an amount of movement in accordance with the accepted inputs of operations of the operation lever and the accelerator (step S10).

Specifically, bucket pivot amount calculator 100 calculates an amount of pivot of the bucket based on the bucket operation amount detected by bucket operation detector 84*b*. Movement amount calculator 102 calculates an amount of movement per command period T of body 2 calculated from the vehicle speed of traveling apparatus 22 in accordance with the accelerator operation amount.

Description will be given of a case in which bucket pivot amount calculator 100 calculates an amount of pivot of the bucket Δt and movement amount calculator 102 calculates an amount of movement Δe.

Subsequently, controller 10 calculates an amount of lift Δr (step S12).

Specifically, boom controller 104 calculates amount of lift Δr based on movement-direction vector V, amount of pivot of the bucket Δt, and amount of movement Δe which have been calculated.

Figure 7:
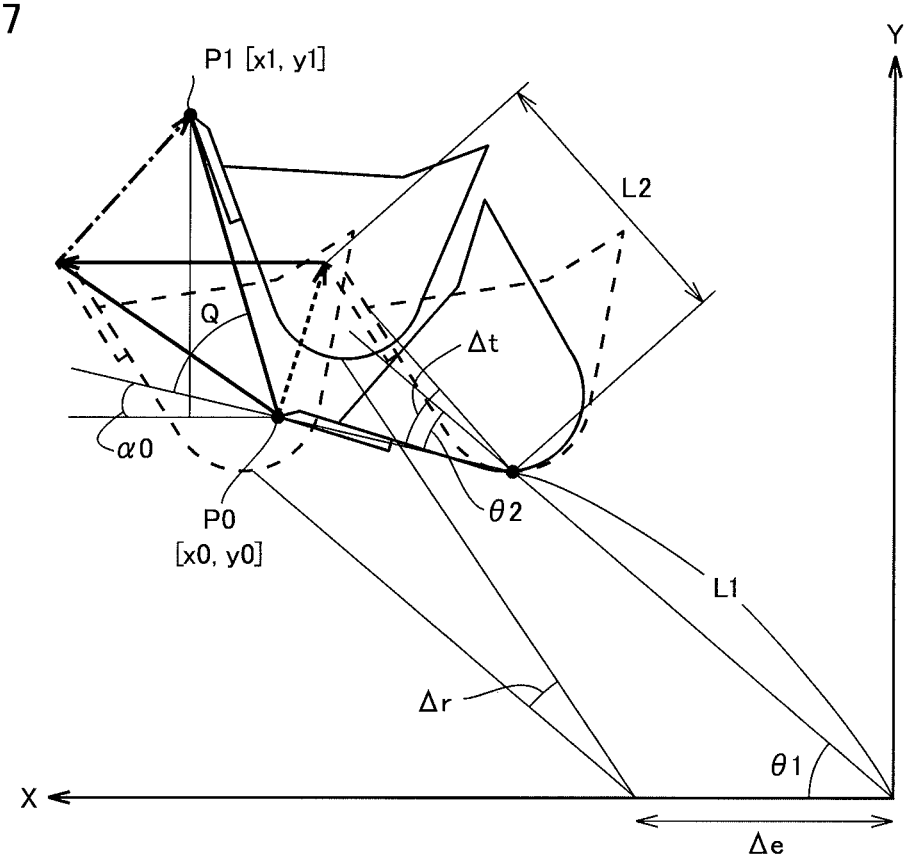
FIG. 7 illustrates calculation of an amount of lift $\Delta r$ according to the embodiment.

FIG. 7 illustrates calculation of amount of lift Δr according to the embodiment.

Data P1 [x1, y1] of the moving cutting edge that moves with respect to a target direction of movement is represented from current data P0 [x0, y0] of the cutting edge, as shown in FIG. 7.

An X-axis component Vx and a Y-axis component Vy of movement-direction vector V in the coordinate system of this example are represented by the following expressions.

$$Vx=x1-x0$$

$$Vy=y1-y0$$

X-axis component Vx and Y-axis component Vy are represented by the following expressions.

$$Vx=\{L1\sin\theta1+L2\sin(\theta1+\theta2)\}\Delta r-L2\sin(\theta1+\theta2)\Delta t+\Delta e$$

$$Vy=\{L1\cos\theta1+L2\cos(\theta1+\theta2)\}\Delta r+L2\cos(\theta1+\theta2)\Delta t \quad \text{[Math 2]}$$

An excavation angle φ of movement-direction vector V is calculated by the following expression.

$$\varphi=\tan(Vy/Vx)^{-1}-\alpha0$$

Amount of lift Δr is calculated such that excavation angle φ attains to a predetermined angle Q.

Amount of lift Δr is calculated by the following expression based on the above expression.

$$\Delta r=\frac{\Delta e\tan(\theta1+\theta2+\gamma+Q)-L2\{\cos(\theta1+\theta2)+\tan(\theta1+\theta2+\gamma+Q)\sin(\theta1+\theta2)\}\Delta t}{L1\cos\theta1+L2\cos(\theta1+\theta2)+\tan(\theta1+\theta2+\gamma+Q)\{L1\sin\theta1+L2\sin(\theta1+\theta2)\}} \quad \text{[Math 3]}$$

Subsequently, controller 10 operates the work implement based on the calculation result (step S14).

Specifically, boom controller 104 drives work implement control valve 34 to regulate the hydraulic oil such that the calculated boom cylinder length is obtained in accordance with the calculated amount of lift Δr.

Consequently, the amount of lift of boom 6 is regulated such that the excavation angle attains to predetermined angle Q, so that boom 6 is automatically controlled.

Subsequently, controller 10 determines whether the work is complete (step S16). The case in which controller 10 determines that the work is complete is, for example, a case in which the engine is stopped.

If determining that the work is complete at step S16 (YES at step S16), controller 10 ends the process (END).

Contrastingly, if determining that the work is not complete at step S16 (NO at step S16), controller 10 returns to step S2 and repeats the above process.

If determining at step S2 that the mode is not the excavation mode, controller 10 accepts inputs of the operations of the operation lever and the accelerator (step S18).

Controller 10 accepts the inputs of operations of boom operation member 83*a*, bucket operation member 84*a*, accelerator operation member 81*a*, and the like.

In the normal mode, boom 6 and bucket 7 are operated by boom operation member 83*a* and bucket operation member 84*a*. The vehicle speed of body 2 is controlled by, for example, accelerator operation member 81*a*.

Subsequently, controller 10 operates the work implement (step S20).

Controller 10 drives work implement control valve 34 through which the hydraulic oil supplied to boom cylinders 14*a* and 14*b* for driving boom 6 flows, in accordance with the detection result of boom operation detector 83*b*. Controller 10 drives work implement control valve 34 through which the hydraulic oil supplied to bucket cylinder 15 for driving bucket 7 flows, in accordance with the detection result of bucket operation detector 84*b*. Controller 10 controls governor 25 that regulates the amount of injection of fuel injected to engine 21 in accordance with the detection result of accelerator operation detector 81*b*.

Subsequently, the process proceeds to step S16.

Since the following process is similar to that described above, detailed description thereof will not be repeated.

The cutting edge direction of the cutting edge of bucket 7 is thus calculated, and the vector in the movement-direction (the direction of movement of the cutting edge by the excavation operation) is calculated such that the excavation angle formed between the direction of the cutting edge of bucket 7 and the direction of movement of the cutting edge of bucket 7 attains to a predetermined angle Q. Automatic control is performed to allow the cutting edge of bucket 7 to move in accordance with the vector in the direction of movement, thus reducing a resistance of soil applied to bucket 7. An efficient excavation operation can be performed in a simple way by reducing the resistance of soil (load) applied to bucket 7.

During a period in which the excavation mode in accordance with an operator's instruction to depress excavation mode setting button 25P is set, an efficient excavation operation with a low load, in which the cutting edge of bucket 7 moves in accordance with a predetermined movement-direction vector, is performed, leading to lower fuel consumption.

Setting can be made to the excavation mode in accordance with an operator's instruction to depress excavation mode setting button 25P, enabling an efficient excavation operation reflecting an operator's intension.

In the excavation mode, bucket operation member 84*a* performs an operation of pivoting bucket 7. Accelerator operation member 81*a* performs an operation of moving body 2. Boom 6 is automatically controlled. Thus, the excavation process is performed by two operation commands.

An excavation operation of a conventional wheel loader, which needs to operate the movement of the bucket by executing three operation commands of the boom, the bucket, and the accelerator, is not easy and requires some skill; however, the movement of the bucket can be operated by two operation commands, and accordingly, an efficient excavation process can be performed through a simple operation.

(Another Embodiment)

Figure 8:
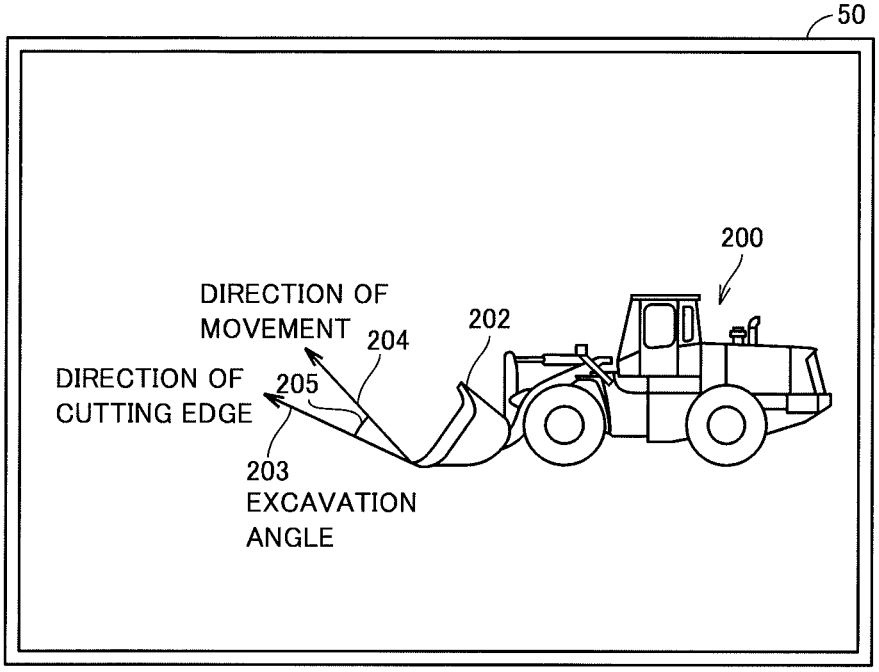
FIG. 8 illustrates a display 50 according to another embodiment.

As another embodiment, guidance regarding the excavation operation can be displayed to an operator, FIG. 8 illustrates a display 50 according to another embodiment.

As shown in FIG. 8, display 50 is provided with an appearance object 200 showing the appearance model of wheel loader 1 viewed laterally, and a bucket object 202 showing the appearance model of bucket 7 of wheel loader 1 viewed laterally.

Display controller 106 calculates the posture of bucket 7 based on the lift length data detected by boom cylinder stroke sensor 95 and the tilt length data detected by bucket cylinder stroke sensor 96, as described with reference to FIG. 3. Display controller 106 shows bucket object 202 in the calculated posture on display 50.

Display controller 106 shows a direction of cutting edge 203, an excavation angle 205, and a direction of movement 204 as the guidance relating to the excavation operation. At least one of these may be displayed.

The operator can easily grasp the direction of cutting edge 7*a* of bucket 7 through display 50 provided in operator's cab 5. Although the operator may be seated on the seat while squarely facing bucket 7 and have difficulty in visually checking the state of cutting edge 7*a* of bucket 7, the operator can easily grasp the direction of cutting edge 7*a* of bucket 7 thanks to bucket object 202 viewed laterally.

As direction of cutting edge 203 is displayed, a direction in which cutting edge 7*a* is oriented can be easily checked.

As excavation angle 205 is displayed with respect to direction of cutting edge 203, an excavation angle with a resistance of soil having a low value can be grasped easily.

Guidance may be shown while being highlighted in various manners, for example, by blinking of a line or application of a color.

Although description will be given of a case in which guidance is shown on display 50 provided in operator's cab 5, display 50 may be placed in a remote place outside operator's cab 5, not limited to in operator's cab 5. For example, display 50 may be placed in a base station in a remote place or the like. The information from display controller 106 may be sent to the base station, and display 50 may be caused to show the information. As the guidance is shown on display 50 also during remote operation of wheel loader 1, the operator can easily check which direction is a direction of movement with a resistance of soil having a low value. The operator can easily operate the work implement through the guidance display, thus performing an efficient excavation process.

Figure 9:
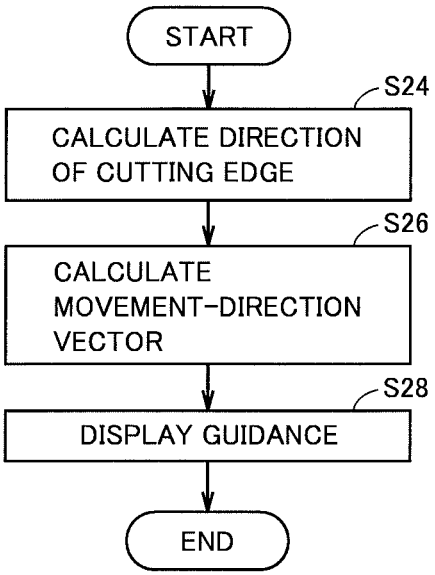
FIG. 9 illustrates a display process of a wheel loader 1 according to the other embodiment.

FIG. 9 illustrates a display process of wheel loader 1 according to the other embodiment.

As shown in FIG. 9, controller 10 calculates the direction of the cutting edge of bucket 7 (step S24). Specifically, display controller 106 calculates a boom cylinder length and a bucket cylinder length based on the detection results of boom cylinder stroke sensor 95 and bucket cylinder stroke sensor 96. A tilt angle θ1 of boom 6 to the horizontal direction is calculated from the boom cylinder length. A tilt angle θ2 of the cutting edge of bucket 7 to boom 6 is calculated from the bucket cylinder length. A cutting edge angle α0 is thus calculated as the angle of the cutting edge (cutting edge direction) of bucket 7.

Subsequently, controller 10 calculates a movement-direction vector V (step S26). Specifically, display controller 106 calculates movement-direction vector V such that an excavation angle formed between the direction of the cutting edge of bucket 7 and the direction of movement of the cutting edge of bucket 7 attains to a predetermined angle Q. This determines the direction of movement of the cutting edge of bucket 7 by the excavation operation.

Subsequently, controller 10 displays guidance relating to the excavation operation (step S28). Specifically, display controller 106 shows, on display 50, a guidance display in accordance with the determined direction of movement of bucket 7 as described with reference to FIG. 8.

Then, the process is ended (END).

As the direction of movement is shown on display 50, the operator can easily check which direction is a direction of movement with a resistance of soil having a low value. The operator can thus easily operate the work implement by this guidance display, thus performing an efficient excavation process.

<Operation and Effect>

An operation and an effect of the embodiment will now be described.

Wheel loader 1 of the embodiment is provided with body 2 that travels in excavation and work implement 3 as shown in FIG. 1. Work implement 3 includes boom 6 pivotable with respect to body 2 and bucket 7 pivotable with respect to boom 6. Wheel loader 1 is provided with controller 10 as shown in FIG. 2. Controller 10 calculates the direction of the cutting edge of bucket 7, determines the direction of movement of the cutting edge by an excavation operation such that an excavation angle between the calculated direction of the cutting edge of the bucket and the direction of movement of the cutting edge by the excavation operation keeps a predetermined angle, and causes wheel loader 1 to perform the excavation operation in the direction of movement.

Controller 10 can determine the direction of movement such that the excavation angle between the direction of the cutting edge of bucket 7 and the direction of movement keeps a predetermined angle Q, and perform the excavation process of work implement 3 at the excavation angle equal to predetermined angle Q with a resistance of soil having the smallest value in order to cause wheel loader 1 to perform the excavation operation as shown in FIG. 5, thus performing an efficient excavation operation in a simple way.

Boom controller 104 of wheel loader 1 calculates an amount of lift by which boom 6 is lifted based on the determined direction of movement of the cutting edge by the excavation operation, the amount of pivot of bucket 7 with respect to boom 6, and the amount of movement of body 2, thereby controlling boom 6 based on the calculated amount of lift.

The amount of lift by which boom 6 is lifted is calculated, and boom 6 is automatically controlled based on the calculated amount of lift, enabling an efficient excavation operation in a simple way.

Wheel loader 1 is further provided with bucket pivot amount calculator 100 and movement amount calculator 102. Bucket pivot amount calculator 100 calculates an amount of pivot of bucket 7 that pivots in accordance with an operation command of bucket operation member 84*a*. Movement amount calculator 102 calculates the amount of movement of body 2 that travels in accordance with the operation command of accelerator operation member 81*a*.

The movement of the bucket can be operated by two operation commands, enabling an efficient excavation process through a simple operation.

Controller 10 determines whether to cause wheel loader 1 to perform the excavation mode in accordance with an operator's instruction to operate excavation mode setting button 25P.

Since setting to the excavation mode can be made in accordance with the operator's instruction to depress excavation mode setting button 25P, an efficient excavation operation reflecting the operator's intention can be performed.

Wheel loader 1 of the embodiment is provided with body 2 that travels in excavation and work implement 3 as shown in FIG. 1. Work implement 3 includes boom 6 pivotable with respect to body 2 and bucket 7 pivotable with respect to boom 6. In the method of controlling wheel loader 1, the following steps are performed: the step of calculating the direction of the cutting edge of bucket 7, the step of determining a direction of movement of the cutting edge by an excavation operation such that an excavation angle between the calculated direction of the cutting edge of the bucket and the direction of movement of the cutting edge by the excavation operation keeps a predetermined angle, and the step of causing wheel loader 1 to perform the excavation operation in the direction of movement.

The excavation process of work implement 3 can be performed at an excavation angle equal to a predetermined angle Q with a resistance of soil having the smallest value as shown in FIG. 5, thus performing an efficient excavation operation in a simple way.

Wheel loader 1 of the present embodiment is provided with body 2 that travels in excavation, work implement 3, and display 50 as shown in FIG. 1. Work implement 3 includes boom 6 pivotable with respect to body 2 and bucket 7 pivotable with respect to boom 6. Wheel loader 1 is provided with display controller 106 as shown in FIG. 2. Display controller 106 calculates a direction of the cutting edge of bucket 7, determines a direction of movement of the cutting edge by an excavation operation such that an excavation angle between the calculated direction of the cutting edge of the bucket and the direction of movement of the cutting edge by the excavation operation keeps a predetermined angle, and shows guidance in accordance with the determined direction of movement on display 50.

Display controller 106 determines the direction of movement such that the excavation angle between the direction of the cutting edge of bucket 7 and the direction of movement keeps a predetermined angle Q, and displays guidance as shown in FIG. 8, so that a direction of movement with a resistance of soil having the smallest value can be checked easily. The operator can easily operate the work implement through this guidance display, thus performing an efficient excavation process.

Wheel loader 1 of the embodiment is provided with body 2 that travels in excavation, work implement 3, and display 50 as shown in FIG. 1. Work implement 3 includes boom 6 pivotable with respect to body 2 and bucket 7 pivotable with respect to boom 6. In the method of controlling wheel loader 1, the following steps are performed: the step of calculating the direction of the cutting edge of bucket 7, the step of determining a direction of movement of the cutting edge by an excavation operation such that an excavation angle between the calculated direction of the cutting edge of the bucket and the direction of movement of the cutting edge by the excavation operation keeps a predetermined angle, and the step of showing guidance in accordance with the determined direction of movement on display 50.

The direction of movement is determined such that the excavation angle between the direction of the cutting edge of bucket 7 and the direction of movement keeps a predetermined angle Q, and guidance as shown in FIG. 8 is displayed, so that the direction of movement with a resistance of soil having the smallest value can be checked easily. The operator can easily operate the work implement through this guidance display, thus performing an efficient excavation process.

Although description has been given by taking a wheel loader as an example of the work vehicle, the preset disclosure is also applicable to a work vehicle such as a bulldozer.

Although embodiments of the present disclosure have been described above, it should be understood that the embodiments disclosed herein are illustrative and non-restrictive in every respect. The scope of the present disclosure is defined by the terms of the claims and is intended to include any modifications within the scope and meaning equivalent to the terms of the claims.

REFERENCE SIGNS LIST

1 wheel loader, 2 body, 2*a* front vehicular body portion, 2*b* rear vehicular body portion, 3 work implement, 4*a*, 4*b* wheel, 5 operator's cab, 6 boom, 7 bucket, 8 operation unit, 9 bell crank, 10 controller, 11*a*, 11*b* steering cylinder, 12 steering pump, 13 work implement pump, 14*a*, 14*b* boom cylinder, 15 bucket cylinder, 16 boom pin, 17 bucket pin, 21 engine, 22 traveling apparatus, 23 torque converter device, 24 fuel injection pump, 25P excavation mode setting button, 26 transmission, 27 lock-up clutch, 28 torque converter, 31 clutch control valve, 32 shaft, 33 PTO shaft, 34 work implement control valve, 35 steering control valve, 60 memory, 81*a* accelerator operation member, 81*b* accelerator operation detector, 82*a* steering operation member, 82*b* steering operation detector, 83*a* boom operation member, 83*b* boom operation detector, 84*a* bucket operation member, 84*b* bucket operation detector, 85*a* transmission operation member, 85*b* transmission operation detector, 86*a* operation member, 86*b* operation detector, 91 engine speed sensor, 92 output speed sensor, 95 boom cylinder stroke sensor, 96 bucket cylinder stroke sensor, 100 bucket pivot amount calculator, 102 movement amount calculator, 104 boom controller.

The invention claimed is:

1. A work vehicle comprising:

a vehicular body that travels in excavation;

a work implement including a boom pivotable with respect to the vehicular body, and a bucket pivotable with respect to the boom; and a controller configured to calculate a direction of a cutting edge of the bucket, determine a direction of movement of the cutting edge by an excavation operation such that an excavation angle between the calculated direction of the cutting edge of the bucket and the direction of movement of the cutting edge by the excavation operation keeps a predetermined angle, and cause the work vehicle to perform the excavation operation in the direction of movement, wherein the controller is configured to, based on the determined direction of movement of the cutting edge by the excavation operation, an amount of pivot of the bucket with respect to the boom, and an amount of movement of the vehicular body, calculate an amount of lift by which the boom is lifted, and control the boom based on the calculated amount of lift.

2. The work vehicle according to claim 1, further comprising:

a bucket pivot amount calculator configured to calculate an amount of pivot of the bucket that pivots in accordance with a first operation command; and a movement amount calculator configured to calculate an amount of movement of the vehicular body that travels in accordance with a second operation command.

3. The work vehicle according to claim 1, wherein the controller is configured to determine whether to cause the work vehicle to perform the excavation operation in accordance with an operation command from an operator.

4. A method of controlling a work vehicle including a work implement including a boom pivotable with respect to a vehicular body that travels in excavation and a bucket pivotable with respect to the boom, the method comprising:

calculating a direction of a cutting edge of the bucket;

determining a direction of movement of the cutting edge by an excavation operation such that an excavation angle between the calculated direction of the cutting edge of the bucket and the direction of movement of the cutting edge by the excavation operation keeps a predetermined angle; and causing the work vehicle to perform the excavation operation in the direction of movement.

5. A work vehicle comprising:

a vehicular body that travels in excavation;

a work implement including a boom pivotable with respect to the vehicular body, and a bucket pivotable with respect to the boom; and a display controller configured to calculate a direction of a cutting edge of the bucket, determine a direction of movement of the cutting edge by an excavation operation such that an excavation angle between the calculated direction of the cutting edge of the bucket and the direction of movement of the cutting edge by the excavation operation keeps a predetermined angle, and show guidance in accordance with the determined direction of movement on a display.

6. A method of controlling a work vehicle including a work implement including a boom pivotable with respect to a vehicular body that travels in excavation and a bucket pivotable with respect to the boom, the method comprising:

calculating a direction of a cutting edge of the bucket;

determining a direction of movement of the cutting edge by an excavation operation such that an excavation angle between the calculated direction of the cutting edge of the bucket and the direction of movement of the cutting edge by the excavation operation keeps a predetermined angle; and showing guidance in accordance with the determined direction of movement on a display.

* * * * *